United States Patent [19]

Ando et al.

[11] Patent Number: 5,044,382

[45] Date of Patent: Sep. 3, 1991

[54] WIG

[75] Inventors: Masaaki Ando, Kanagawa; Ryuji Teratoko, Tokyo, both of Japan

[73] Assignee: Aderans Co., Ltd., Tokyo, Japan

[21] Appl. No.: 594,700

[22] Filed: Oct. 9, 1990

[30] Foreign Application Priority Data

Dec. 31, 1989 [JP] Japan ..... 1-341344

[51] Int. Cl.[5] ..... A41G 5/00

[52] U.S. Cl. ..... 132/54; 132/53; 132/56

[58] Field of Search ..... 132/53, 54, 55, 56, 132/201

[56] References Cited

U.S. PATENT DOCUMENTS

| | | | |
|---|---|---|---|
| 1,740,764 | 12/1929 | Borg | 132/56 |
| 1,845,380 | 2/1932 | Westmore | 132/53 |
| 2,814,301 | 11/1957 | Schmitz | 132/56 |
| 3,225,724 | 12/1965 | Clossert | 132/53 |
| 3,654,935 | 4/1972 | Brown | 132/53 |
| 3,670,741 | 6/1972 | Utsunomiya | 132/201 |
| 3,970,092 | 7/1976 | Nelson | 132/53 |
| 4,799,502 | 1/1989 | Kobayashi et al. | 132/53 |

*Primary Examiner*—John J. Wilson
*Assistant Examiner*—Frank A. LaViola
*Attorney, Agent, or Firm*—Nixon & Vanderhye

[57] ABSTRACT

In a wig, a hair-planting framework bulges outwardly as a whole to have a cap-like outer configuration. The hair-planting framework has a peripheral-edge frame formed generally into an elongated elliptic configuration, and interlocking chain-like thread elements each of which is formed by a filament so knitted as to have stretchability. The chain-like thread elements are arranged within the peripheral-edge frame in intersected relation. The chain-like thread elements are fastened to the peripheral-edge frame to define openings in the hair-planting framework. When the wig is worn onto a head of a wearer, strands of existing hair of the wearer are drawn outwardly through the openings and are blended with strands of hair planted to the hair-planting framework.

20 Claims, 6 Drawing Sheets

WIG

BACKGROUND OF THE INVENTION

The present invention relates to wigs capable of being easily worn on and fixed to a head of a wearer and, more particularly, to a wig which is used under a thin-hair condition that is the early stage of falling-out of hair, or which is used in an attempt to obtain a fashion effect.

Conventionally, a wig has widely been used in which, as a wig base for covering a head of a wearer, utilized is a wig base formed by artificial skin made of a soft synthetic resinous material or the like rich in flexibility, and/or a net base having a plurality of fine meshes. A plurality of strands of hair are planted to the wig base.

If the wig, which uses the above-mentioned wig base made of the soft synthetic resinous material, is worn on the head of the wearer for a long period of time, skin breathing of a scalp is impeded and the scalp tends to become stuffy. Accordingly, an attempt has been made to form a plurality of fine perforations through the wig base thereby causing air to flow or to be circulated between the inside and outside of the wig base to loose moisture or humidity to the ambient atmosphere. However, such attempt has not been sufficient.

Further, a wig is also known in which a net made of nylon or the like is used as a wig base, and a plurality of strands of hair are planted to the net. In order to improve or increase the density of a quantity of strands of hair planted, the net has usually fine meshes such as 15 through 50 meshes per 2.54 mm. For this reason, when the wig is worn on the head of the wearer, the strands of existing hair are pressed beneath the net so that the wearer has a sense of oppression. Moreover, a hair style becomes flat so that the wig is deteriorated also in permeability. Furthermore, if the meshes of the net are small or fine, the net base appears like a planar surface configuration or a planar plate configuration. Thus, the net is easy to be discovered or exposed through gaps between the strands of hair planted to the wig base.

By the way, in order to wear the wig constructed as above onto the head of the wearer, an appropriate number of anchoring members or wig pins are used which are mounted to the rear surface of the base made of the synthetic resinous material or the rear surface of the net base. The strands of existing hair of the wearer are clamped between the pins, and the wig is fixed in position to the head of the wearer through the pins.

However, interposition of the wig pins between the wig base and the head of the wearer causes the wig to float up correspondingly so that the wig is not sufficiently fitted about the head. Thus, there is a feeling of physical disorder in wearing and in appearance. Further, there is such a disadvantage that, if the remaining strands of hair or the strands of existing hair are clamped between the pins, and if the clamping force of the pins is strong, for example, the remaining strands of hair are damaged at the clamping locations.

SUMMARY OF THE INVENTION

It is therefore an object of the invention to provide a wig in which, when the wig is worn on a head of a wearer, skin breathing of a scalp is not impeded, and the wig is well fitted about the head of the wearer so that a thin-hair portion of the wearer can be concealed in an extremely natural feeling, and in which the wig can easily be mounted to and demounted from the head of the wearer without injury of the strands of existing hair.

It is another object of the invention to provide a wig in which an artificial skin and a net having fine meshes, which are heavy in weight per se, pins and so on are not used so that the wig is light in weight and rich in flexibility, whereby the wig is easy in handling.

For the above purpose, according to the invention, there is provided a wig comprising:

a hair-planting framework bulging outwardly as a whole to have a cap-like outer configuration, the hair-planting framework having a peripheral-edge frame formed generally into an elongated elliptic configuration, and a plurality of chain-like thread elements each of which is formed by a filament so knitted as to have stretchability, the chain-like thread elements being arranged within the peripheral-edge frame in intersected relation to each other, the chain-like thread elements being fastened to the peripheral-edge frame to define a plurality of openings in the hair-planting framework; and a plurality of strands of hair planted to the hair-planting framework so as to extend outwardly thereof, wherein, when the wig is worn onto a head of a wearer, a plurality of strands of existing hair of the wearer are drawn outwardly through the openings in the hair-planting framework and are blended with the strands of hair planted to the hair-planting framework.

With the arrangement of the invention, when the wig is worn on the head of the wearer, the neighborhood or vicinity of a central region of the hair-planting framework is first pressed against a crown of the head of the wearer. A pair of strings or straps mounted respectively to left- and right-hand portions of the peripheral-edge frame are tied under a chin of the wearer, to pull the peripheral-edge frame downwardly.

Since the hair-planting framework forming the wig is constituted by the plurality of chain-like thread elements to which stretchability is given, the wig can closely be fitted under expansion or stretch about at least a part of the head of the wearer on which the wig is to be worn, without occurrence of looseness or slackness.

Under the condition described above, the strands of existing hair of the wearer are drown outwardly through the openings in the hair-planting framework by means of a brush or the like. The drown strands of hair are blended with the strands of hair planted to the hair-planted framework, and are set. Subsequently, the pair of strings are removed. Thus, the strands of existing hair and the strands of hair of the wig are interlocked with each other, and the chain-like thread elements forming the hair-planting framework tend to contract. Parts of the chain-like thread elements, which are arranged perpendicularly to a hair flow or stream of the strands of existing hair of the wearer are in pressure contact with a skin of the wearer's head at locations in the vicinity of roots of the strands of existing hair which are drawn outwardly through the openings. Thus, the wig is fixed to the head of the wearer as a whole while being prevented from floating up from the head of the wearer.

As described above, according to the invention, the wig does not impede skin breathing of the scalp of the wearer's head. Further, the wig can closely be fitted about the head of the wearer and can easily be fixedly mounted to the head of the wearer. Thus, there is provided the wig which can conceal a thin-hair portion of the head of the wearer in an extremely natural feeling without damage of the strands of existing hair of the wearer. Further, there can be provided the wig which is used for fashion rich in decoration.

DETAILED DESCRIPTION

Figure 1:
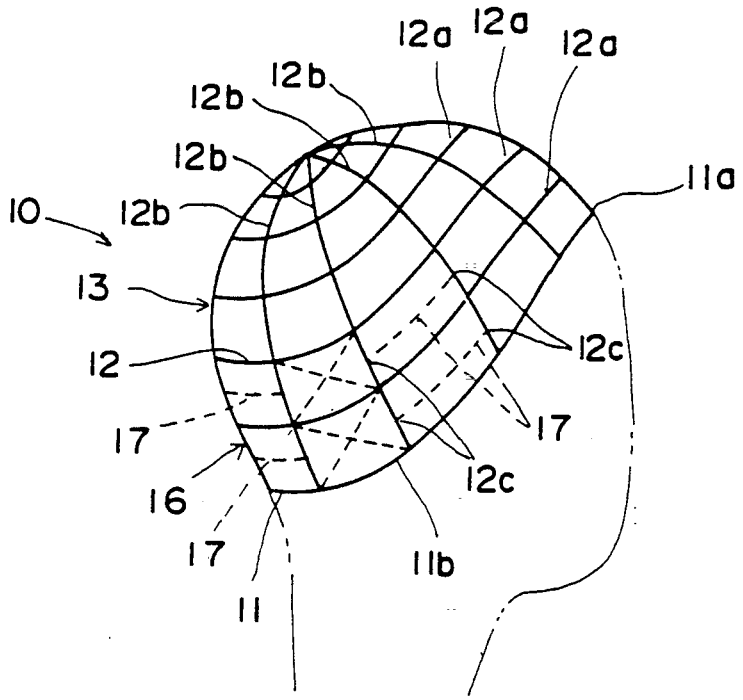
FIG. 1 is a perspective view showing the entirety of a wig according to an embodiment of the invention.

Referring to FIG. 1, there is shown, in a perspective view, a wig 10 according to an embodiment of the invention, with strands of hair omitted from illustration. The wig 10 is worn on a head of a wearer. The wig 10 has a hair-planting framework 13 and a plurality of strands of hair H (not shown in FIG. 1, but see FIGS. 3(A) through 7) planted to the hair-planting framework 13. The hair-planting framework 13 comprises a peripheral-edge frame 11 and a plurality of chain-like thread elements 12 which are arranged longitudinally and latitudinally within the peripheral-edge frame 11.

The peripheral-edge frame 11 is formed into an annular shape substantially in the form of an elongated elliptic configuration extending along an outer peripheral edge of the hair-planting framework 13. The peripheral-edge frame 11 has a sincipital section formed by a thread element 11*a*, and an occipital section formed by a stretchable thread element 11*b*. It is preferable that the thread element 11*a* of the sincipital section is made of nylon or of a material like the thread element 12 knitted into a chain-like configuration, and the stretchable thread element 11*b* of the occipital section is made of rubber. If a raw material of the thread element 11*a* is nylon, the raw material per se is non-stretchable per se, but slight stretchability may be given to the thread element 11*a*. Both the thread elements 11*a* and 11*b* are fastened to each other at a location substantially midway of the hair-planting framework 13. Accordingly, when the wig 10 is worn onto the head of the wearer, the thread element 11*a* of the peripheral-edge frame 11 is in pressure contact with or is abutted against the vicinity of the sinciput of the wearer's head, which has a generally convexly curved configuration. The stretchable thread element 11*b* contracts along the nape of the wearer, which gradually becomes a concave configuration from the projecting occiput of the wearer, so that the stretchable thread element 11*b* is closely fitted to the nape of the wearer. Thus, the peripheral-edge section of the wig 10 is suitably fitted about the head of the wearer, and is fixed thereto.

Figure 2:
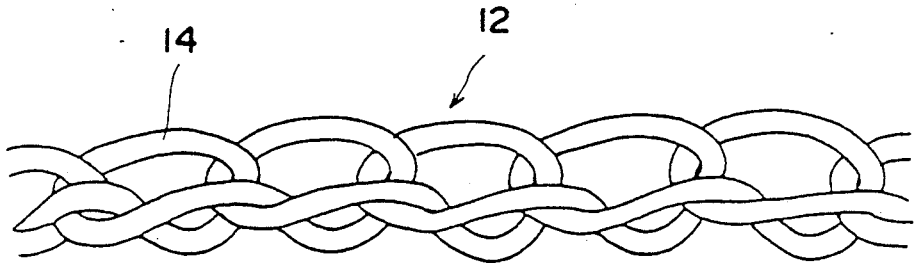
FIG. 2 is an enlarged fragmentary perspective view of one of a plurality of chain-like thread elements which are used in the wig illustrated in FIG. 1.
Figure 3:
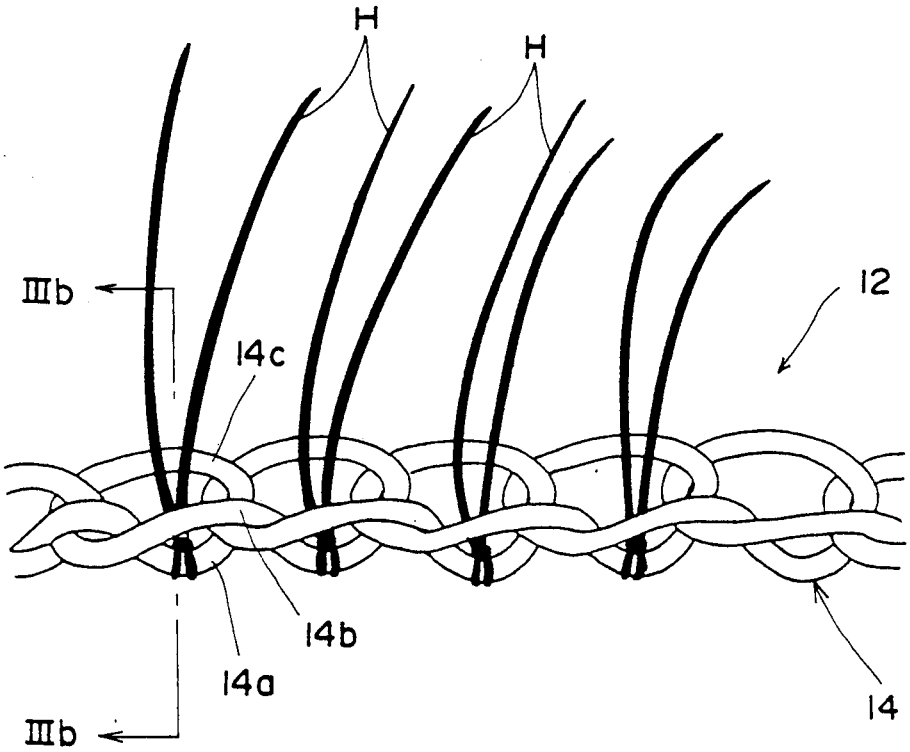
FIG. 3(A) is an enlarged fragmentary perspective view showing a first hair-planting method of the wig illustrated in FIG. 1.
FIG. 3(B) is a cross-sectional view taken along the line IIIb—IIIb in FIG. 3(A)
Figure 3:
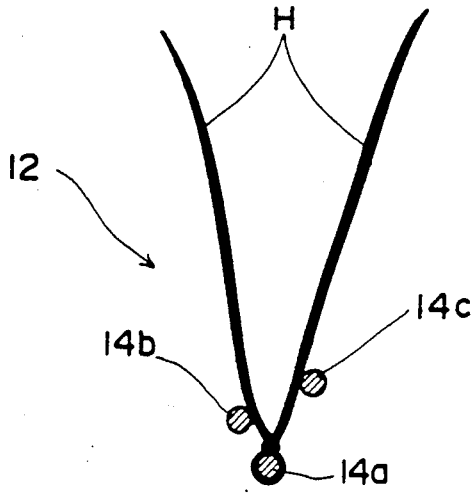

In the illustrated embodiment, as shown in FIG. 2 in an enlarged view, each of the chain-like thread elements 12 is formed by a single filament 14 which is so chain-knitted as to have certain stretchability. It is preferable that the filament 14, by which each of the chain-like thread elements 12 is formed, is made of a resinous material such as nylon, polyester or the like. However, the filament 14 is not limited to nylon or polyester. Further, the strands of natural hair of the wearer normally or usually have a diameter of approximately 0.07 mm through 0.1 mm. Accordingly, in order to prevent the filament 14 from becoming extremely larger in diameter than the usual strands of natural hair of the wearer so that the filament 14 is easy to be viewed, it is preferable that the filament 14 is used which has a cross-sectional diameter of approximately 0.05 mm to 0.2 mm. In FIGS. 3(A) through 7, the filament 14 has its diameter which is illustrated in an exaggerated manner, as compared with thickness of the strands of hair H or 15.

A knitting method of the filament 14 can be selected from rib stitch, chain stitch and the like. For instance, the filament 14 is knitted as illustrated in FIG. 2, whereby, even if the filament 14 per se is not provided with stretchability, stretchability in the left- and right-hand directions in FIG. 2 is given to the chain-like thread element 12.

In this manner, as shown in FIG. 1, the stretchable chain-like thread elements 12 include a predetermined number of latitudinal elements 12*a* extending centering around the crown of the hair-planting framework 13 and a predetermined number of longitudinal elements 12*b*. The latitude and longitudinal elements 12*a* and 12*b* are arranged within the peripheral-edge frame 11 in intersected relation to each other. The latitude and longitudinal elements 12*a* and 12*b* arranged in intersected relation to each other are fastened or bonded to each other at the intersections. That is, the chain-like thread elements 12*a* and 12*b* are spaced from each other and are fastened to the peripheral-edge frame 11 to define a plurality of openings in the hair-planting framework 13. As shown in FIG. 1, the hair-planting framework 13 bulges outwardly as a whole to have a cap-like outer configuration which is in conformity with the configuration of the head of the wearer.

Thus, as illustrated in FIG. 1, if the vicinity of the central region of the hair-planting framework 13 is pressed against the crown of the head of the wearer, and if the hair-planting framework 13 is stretched and worn onto the head, the chain-like thread elements 12 are pulled or drawn longitudinally thereof so that chain loops of the elements 12 are reduced in diameter. The chain-like thread elements 12 are extended or expanded correspondingly to the reduction in diameter. The chain-like thread elements 12 tend to contract under a reaction force of the extension or expansion of the chain-like thread elements 12. At this time, mainly the chain-like thread elements 12*a*, which are arranged in the form of latitude lines, are in pressure contact with the skin of the wearer's head at locations in the vicinity of roots of the respective strands of existing hair (not shown) of the wearer. The chain-like thread elements 12 are pressed down or held down so as not to float up in the vicinity of the roots of the respective strands of existing hair of the wearer. Thus, the wig 10 can be worn onto the head of the wearer as a whole.

In connection with the above, the configuration of the openings defined by the chain-like thread elements 12 is not limited to rectangle or trapezoid. For example, the chain-like thread elements 12 may be arranged in intersected relation so as to define relatively large diamond openings within the peripheral-edge frame 11. If desired, the openings defined by the chain-like thread elements 12 may be a triangular or pentagonal configuration, or other any configuration. Further, a number of the used chain-like thread elements 12 can suitably be regulated in accordance with the condition of falling-out of hair of the thin-hair section of the wearer's head which is to be concealed, subsequently to be described.

The plurality of strands of hair H are planted to the hair-planting framework 13 so as to extend outwardly, in the following manner.

Reference should first be made to FIGS. 3(A) and 3(B). The strands of hair H are planted onto the chain-like thread elements 12 which cooperate with each other to form the hair-planting framework 13. At this time, the filament 14 forming each of the chain-like thread elements 12 is knitted into a chain configuration. By doing so, the filament 14 has an inverted triangular cross-sectional configuration in a plane perpendicular to the longitudinal direction of the filament 14. That is, the filament 14 has the inverted triangular cross-sectional configuration having three filament sections 14*a*, 14*b* and 14*c*. One of the three filament sections 14*a* is located below the remaining two filament sections 14*b* and 14*c*. At least one or two of the strands of hair H are planted to, specifically, to fastened or bonded to, the one filament 14*a* so as to extend outwardly through a space defined by the remaining two filament sections 14*b* and 14*c*.

As described above, the remaining two filament sections 14*b* and 14*c* are located above the one filament section 14*a* with the latter located between the remaining two filament sections 14*b* and 14*c*. Accordingly, as shown in FIG. 3(B), the remaining two filament sections 14*b* and 14*c* are abutted respectively against the outwardly extending two strands of hair H fastened or bonded to the one filament section 14*a*, to support the two strands of hair H substantially perpendicularly to the hair-planting framework 13. Thus, since the strands of hair H can be held substantially perpendicularly to the hair-planting framework 13, the filament 14 shown in FIGS. 3(A) and 3(B) is suitable for hair fastening or bonding onto a portion of the hair-planting framework 13 which is located, for example, at the crown of the head of the wearer.

Figure 4A:
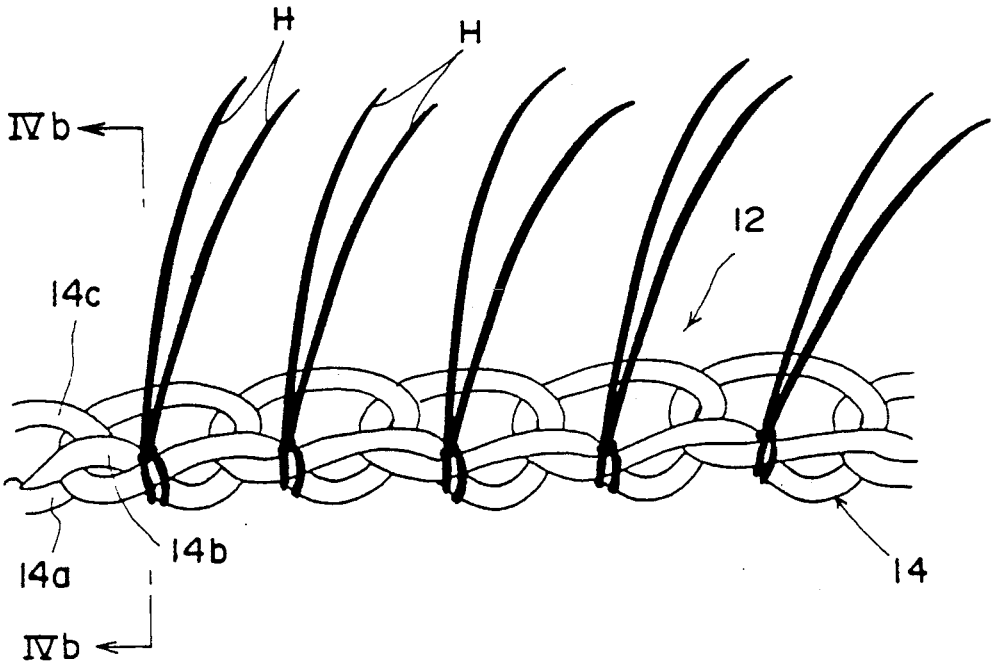
FIG. 4(A) is an enlarged fragmentary perspective view showing a second hair-planting method of the wig illustrated in FIG. 1.
Figure 4B:
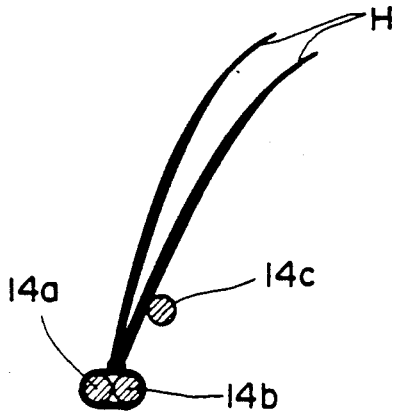
FIG. 4(B) is a cross-sectional view taken along the line IVb—IVb in FIG. 4(A)

FIGS. 4(A) and 4(B) show another hair-planting method with respect to the hair-planting framework 13.

The filament 14 forming each of the chain-like thread elements 12 is knitted as illustrated in FIGS. 4(A) and 4(B). By doing so, the filament 14 has a triangular cross-sectional configuration in a plane which extends perpendicularly to the longitudinal direction of the filament 14. That is, the filament 14 has the triangular cross-sectional configuration having three filament sections 14*a*, 14*b* and 14*c*. One of the three filament sections 14*c* is located above the remaining two filament sections 14*a* and 14*b*. At least one or two of the strands of hair H planted to the hair-planting framework 13 are fastened to the remaining two filament sections 14*a* and 14*b* and extend outwardly while being supported by the one filament section 14*c*. That is, the remaining two filament sections 14*a* and 14*b* are located adjacent each other, and the strands of hair H have their connection portion which is fastened about the remaining two filament sections 14*a* and 14*b*. Thus, the strands of hair H have their forward ends which project outwardly or upwardly. The strands of hair H planted to the remaining two filament sections 14*a* and 14*b* are abutted against the one filament section 14*c* and extend perpendicularly to the hair-planting framework 13. As compared with the case where the strands of hair H are planted to a single filament section, it is reduced that the fastening portion of the strands of hair H after having been planted is moved angularly about the filament 14 in the peripheral direction thereof so that the strands of hair H are moved angularly to a location below the hair-planting framework 13. Thus, it can effectively be prevented to damage the hair style of the wig 10.

If the connection portion of the strands of hair H is wounded about the three filament sections 14*a*, 14*b* and 14*c* and is fastened thereto, the hair-planting operation per se is easy, but deviation or shift in position of the strands of hair H is easy to occur along the length of the filament 14 or the chain-like thread element 12 so that the planted strands of hair H would be prejudiced or biased on the chain-like thread element 12, with the result that a uniform increase in the quantity of hair becomes impossible. By the contrary, as illustrated in FIGS. 4(A) and 4(B), if the connecting portion of the strands of hair H is fastened to the two filament sections 14*a* and 14*b*, there is no such a fear that a knot of the strands of hair H planted slides longitudinally over or beyond each of chain-like loops which form the chain-like thread element 12.

In connection with the above, the strands of hair H planted to the hair-planting framework 13 may be strands of natural hair, strands of synthetic hair or a mixture thereof.

Further, the strands of hair H are planted to each of the filaments 14 in the following manner so that it is possible to produce a suitable wig.

Figure 5:
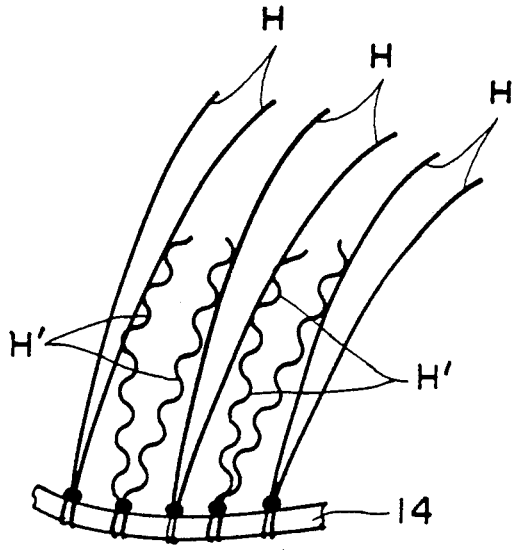
FIG. 5 is a fragmentary perspective view showing a third hair-planting method of the wig illustrated in FIG. 1, with the chain-like thread element being illustrated as being a mere thread element for easiness of illustration.

FIG. 5 shows, in an enlarged view, a condition of hair planting with respect to the filament 14. Please note that, in FIG. 5, the chain-like thread element 14 is illustrated as being a mere thread element for easiness of illustration. The filament 14 has its diameter which is illustrated in FIG. 5 in an exaggerated manner. To speak the truth, the filament 14 is used which has its diameter substantially the same as that of the strands of hair H. The usual or normal strands of hair H are planted to the filament 14, and a plurality of strands of curly hair H' are planted respectively between the strands of hair H by mixture thereof. The strands of curly hair H' are shorter in length than the strands of hair H. It is unnecessary that the strands of curly hair H' are fastened or bonded to the filament 14 at respective locations between the strands of hair H planted. However, the strands of curly hair H' are planted to the hair-planting framework 13 at locations respectively adjacent the strands of hair H planted to the hair-planting framework 13 at predetermined intervals. By doing so, the strands of hair H are supported outwardly or upwardly by the strands of curly hair H' so that a volume feeling can be given to the strands of hair of the wearer as a whole.

The wig 10 according to the embodiment of the invention is constructed as described above, and is worn on the head of the wearer in the following manner.

Description will first be made with reference to FIG. 1. A pair of strings or straps are first mounted respectively to left-and right-hand portions of the peripheral-edge frame 11. The vicinity of the central region of the hair-planting framework 13 is pressed against the crown of the wearer's head. The pair of strings are tied under a chin of the wearer, while being drawn downwardly. By doing so, since the hair-planting framework 13, which forms the wig 10, is made of the chain-like thread elements 12 to which stretchability is given, the chain-like thread elements 12*a* and 12*b* are stretched latitudinally and longitudinally, so that the hair-planting framework 13 is closely fitted onto the head of the wearer with a suitable contracting force to cover the wearer's head as a whole. The sincipital section or thread element 11*a* of the peripheral-edge frame 11 is located at a hairline of the forehead of the wearer, and the occipital section or stretchable thread element 11*b* is located at the nape of the wearer.

Since the thread element 11*a* of the peripheral-edge frame 11 is made of nylon or of a material like the thread element 12 knitted into a chain-like configuration, the thread element 11*a* is pressed against the forehead of the wearer presenting the convex configuration as a whole, under the contracting force of the stretchable thread element 11*b*, so that the thread element 11*a* is suitably fitted to the forehead of the wearer. Further, the stretchable thread element 11*b* of the peripheral-edge frame 11 contracts so as to be fitted, under contraction, to the nape of the wearer which presents the concave configuration, from the occiput of the wearer. Thus, it is possible to prevent the peripheral-edge frame 11 to come off or to be separated from the head of the wearer without occurrence of wrinkles and looseness.

Figure 6:
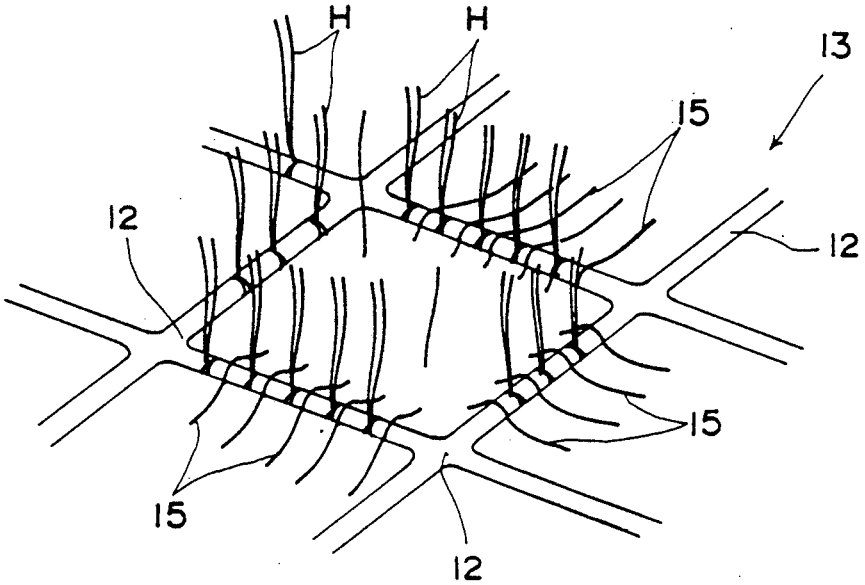
FIG. 6 is an enlarged fragmentary perspective view showing a method of wearing the wig illustrated in FIG. 1, with the chain-like thread elements being illustrated as being mere thread elements for easiness of illustration.

Subsequently, as illustrated in FIG. 6 which shows, in an enlarged view, such a condition that the chain-like thread elements 12 are arranged in a lattice manner to form the plurality of openings, a conditioning brush or the like is utilized to draw the strands of existing hair 15 of the wearer through the relatively large openings in the hair-planting framework 13. Please note that, in FIG. 6, the chain-like thread elements 12 is illustrated as being mere thread elements for easiness of illustration. By simple operation such as brushing or the like, the strands of existing hair 15 of the wearer are mixed with the strands of hair H planted to the hair-planting framework 13. By doing so, the strands of existing hair 15 of the wearer are mixed with the strands of hair H to increase the quantity of hair on the wearer, so that concealing of the thin-hair portion of the wearer is substantially achieved.

Lastly, the pair of strings, which are hung from the left-and right-hand portions of the peripheral-edge frame 11, are released and removed. The chain-like thread elements 12 arranged longitudinally and latitudinally within the peripheral-edge frame 11 contract in their respective directions in which the chain-like thread elements 12 extend. Thus, the hair-planting framework 13 can be fitted as a whole to the head of the wearer without occurrence of looseness.

Figure 7:
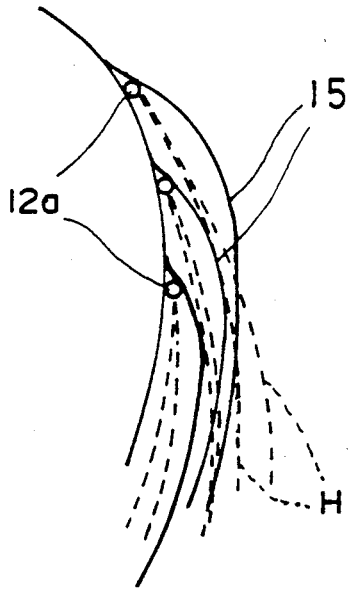
FIG. 7 is a fragmentary cross-sectional view showing a fixing or wearing condition of the wig illustrated in FIG. 1.

Under this condition, as shown in FIG. 7, the chain-like thread elements 12*a*, which form the latitude lines within the hair-planting framework 13, extend perpendicularly to the strands of existing hair 15 of the wearer and are in pressure contact with or are abutted against the skin of the head of the wearer at locations in the vicinity of roots of the respective strands of existing hair 15. That is, the chain-like thread elements 12*a* are abutted, substantially along their longitudinal direction, against the vicinity of the roots of the respective strands of existing hair 15 of the wearer in a direction perpendicular to the direction of the flow or stream of the strands of existing hair 15, at locations where the strands of existing hair 15 form the stream of hair extending vertically.

Here, the chain-like thread elements 12*a* in the latitude direction are pulled or stretched under the force of the longitudinal chain-like thread element 12*b* (not shown in FIG. 7, but refer to FIG. 1), which tends to contract in a direction opposite to the stream of the strands of existing hair 15, that is, in a direction toward the crown of the wearer's head. By the force, the chain-like thread elements 12*a* in the latitude direction are in pressure contact with the vicinity of the roots of the strands of existing hair 15. Thus, by the action of the pressure-contact force, the wig 10 can be fixed to the head of the wearer without occurrence of deviation or shift in position as a whole. Further, although FIG. 7 shows only the condition under which the chain-like thread elements 12*a* are in pressure contact with the vicinity of the roots of the strands of existing hair 15, the strands of existing hair 15 are different in stream of hair from each other, depending upon locations where the strands of existing hair 15 are grown. Thus, at locations other than the above-described locations, there is a case where the chain-like thread elements 12*b* are in pressure contact with the vicinity of the roots of the strands of existing hair 15.

In connection with the above, since the chain-like thread elements 12 are held under expansion or stretch condition at the time the wig 10 is worn on the head of the wearer, wrinkles or looseness does not occur in the hair-planting framework 13. Thus, the wig 10 can closely be fitted to the head of the wearer.

Furthermore, as described above with reference to FIG. 5, if the strands of curly hair H' are planted to the hair-planting framework 13 by mixture with the strands of hair H planted to the hair-planting framework 13, the strands of curly hair H' support the strands of hair H, so that the rising condition of the strands of hair H can well be held. Thus, it is possible to prevent the strands of hair H from falling down so that the quantity of strands of hair appears poorly. Further, by interposition of the strands of curly hair H' between the strands of hair H, the condition can be held under which the strands of hair H rise while maintaining their intervals. Accordingly, it is possible to increase a feeling of volume of the wig 10 as a whole, more than a substantial increase in the number of the entire strands of hair. In addition, the strands of curly hair H' act not only on the strands of hair H, but also similarly on the strands of existing hair 15 which are drown through the openings in the hair-planting framework 13 and which are blended with the strands of hair H. Thus, the strands of curly hair H' can further contribute to an improvement in the entire feeling of volume.

Moreover, the plurality of strands of curly hair H' are planted to the hair-planting framework 13 whereby it becomes difficult that the chain-like thread elements 12 can be viewed, from the outside, at the roots of the strands of hair H planted to the hair-planting framework 13.

When the wig 10 is removed from the head of the wearer, the peripheral-edge frame 11 in the vicinity of, for example, the forehead of the wearer is picked by the wearer's fingers and is torn off upwardly. Thus, it is possible to remove the wig 10 extremely easily.

Referring again to FIG. 1, the case will be described where a condition of falling-out of hair proceeds in the vicinity of, for example, the occiput 16 of the wearer's head, and it is necessary to increase a quantity of hair at the vicinity of the occiput 16 more than other thin-hair locations. In this case, at least one or a plurality of hair-increasing chain-like thread elements 17 are provided each of which extends between and is fastened to selected two of the chain-like thread elements 12. At least one or a plurality of strands of hair similar to the strands of hair H are planted to the hair-increasing chain-like element 17 to partially increase the strands of hair planted to the hair-planting framework 13. The hair-increasing chain-like thread elements 17 are similar in construction to the aforesaid chain-like thread elements 12. Both ends of each of the hair-increasing chain-like thread elements 17 are fastened, directly or by the use of threads or the like, respectively to locations 12*c* in the vicinity of intermediate portions of the respective adjacent chain-like thread elements 12*b* which define one of the openings in the hair-planting framework 13.

In the manner described above, the wig 10 according to the embodiment of the invention can increase the quantity of hair at the occiput of the wearer's head correspondingly to the strands of hair planted to the hair-increasing chain-like thread elements 17. Accordingly, the wig 10 is used also to the wearer who is not uniform in thin-hair condition of the wearer's head, whereby it is possible to present an appearance which is provided with a uniform quantity of hair as a whole.

Figure 8:
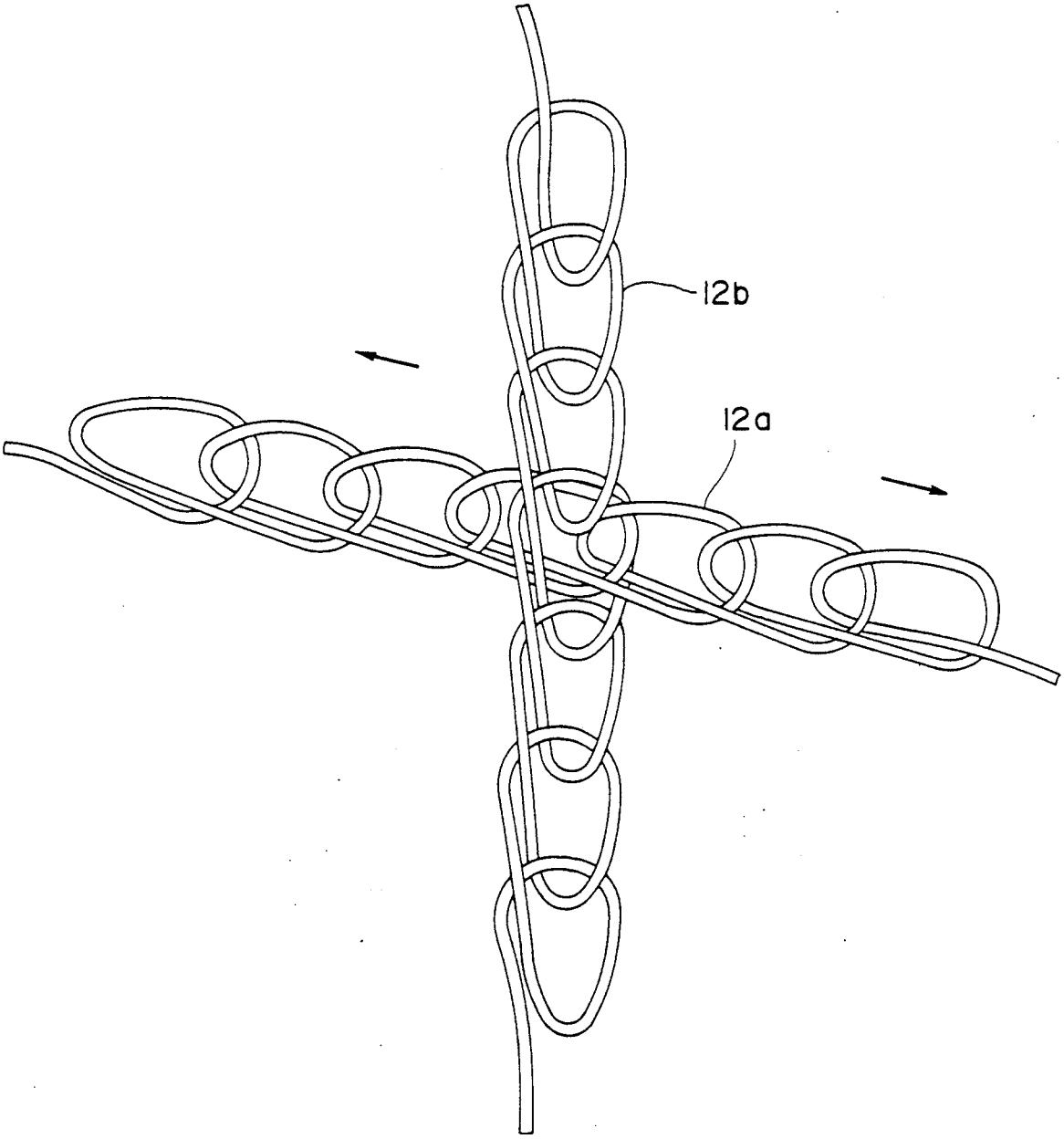
FIG. 8 is a fragmentary enlarged perspective view showing an example in which one of a pair of chain-like thread elements intersected with each other is inserted through one of links of the other chain-like thread element so that the other chain-like thread element is slidable along the length of the one chain-like thread element.

Further, as shown in FIG. 8, both the pair of thread elements intersected with each other are not fixedly mounted to each other, but the arrangement may be such that one of the pair of thread elements intersected with each other, for example, one thread element 12*a* in the latitude direction is inserted through one of links of the other thread element 12*b* in the longitudinal direction. With the arrangement, the other thread element 12*b* is slidable along the length of the one thread element 12*a*. In this manner, if the other thread element 12*b* is slidable along the length of the one thread element 12*a*, the following advantage can be produced. That is, when the strands of existing hair are brushed and are drawn trough the openings in the hair-planting framework, the other thread element 12*b* slides along the length of the one thread element 12*a* to enlarge the openings. By doing so, drawing of the strands of existing hair through the openings is made easy. Further, it is made also easy to adjust uniformity of the quantity of hair.

In connection with the above, in the case where falling-out of hair proceeds partially so that a thin-hair location must be concealed where the skin can be viewed from the outside, the chain-like thread elements 12, the hair-increasing chain-like thread elements 17 and the vicinity of the roots of the strands of hair planted to the chain-like thread elements 12 and 17, which are located at the thin-hair location, are colored to their colors approximate to a color of the skin of the head of the wearer. By doing so, the chain-like thread elements 12, on which the strands of hair H are planted, and so on are difficult to be viewed from the outside. Thus, there can be provided a camouflaging effect in which the fact that the wig 10 is worn cannot be revealed or found out.

What is claimed is:

1. A wig comprising:

a hair-planting framework bulging outwardly as a whole to have a cap-like outer configuration, said hair-planting framework having a peripheral-edge frame formed generally into an elongated elliptic configuration, and a plurality of interlocking chain-like thread elements each of which is formed by a filament so knitted as to have stretchability, said chain-like thread elements being arranged within said peripheral-edge frame in interlocking intersected relation to each other, said chain-like thread elements being fastened to said peripheral-edge frame to define a plurality of openings in said hair-planting framework; and a plurality of strands of hair planted to said hair-planting framework so as to extend outwardly thereof, wherein, when said wig is worn onto a head of a wearer, a plurality of strands of existing hair of the wearer are drawn outwardly through said openings in said hair-planting framework and are blended with said strands of hair planted to said hair-planting framework.

2. The wig according to claim 1, wherein said peripheral-edge frame has a sincipital section formed by a thread element, and an occipital section formed by a stretchable thread element.

3. The wig according to claim 2, wherein said thread element of said sincipital section is made of nylon, and said stretchable thread element of said occipital section is made of rubber, said thread elements being fastened to each other at a location substantially midway of said hair-planting framework.

4. The wig according to claim 1, wherein said peripheral-edge frame has a sincipital section formed by a chain-like thread element, and an occipital section formed by a stretchable thread element.

5. The wig according to claim 1, wherein said filament, by which each of said chain-like thread elements is formed, is made of nylon.

6. The wig according to claim 5, wherein said filament, by which each of said chain-like thread elements is formed, has a cross-sectional diameter which is approximately 0.05 mm to 0.2 mm.

7. The wig according to claim 1, wherein said filament, by which each of said chain-like thread elements is formed, is rib-stitched.

8. The wig according to claim 1, wherein said filament, by which each of said chain-like thread elements is formed, is chain-stitched.

9. The wig according to claim 1, wherein each of said chain-like thread elements has an inverted triangular cross-sectional configuration having three filament sections, one of said three filament sections being located below the remaining two filament sections, at least one of said strands of hair planted to said hair-planting framework being planted to said one filament section and extending from said one filament section through a space defined by the remaining two filament sections.

10. The wig according to claim 9, wherein at least two of said strands of hair planted to said hair-planting framework are planted to said one filament section, and that the remaining two filament sections are abutted respectively against the two strands of hair planted to said one filament section, to support said two strands of hair substantially perpendicularly to said hair-planting framework.

11. The wig according to claim 1, wherein each of said chain-like thread elements has a triangular cross-sectional configuration having three filament sections, one of said three filament sections being located above the remaining two filament sections, at least one of said strands of hair planted to said hair-planting framework being fastened to the remaining two filament sections and extending outwardly while being supported by said one filament section.

12. The wig according to claim 11, wherein the remaining two filament sections are located adjacent each other, and at least two of said strands of hair planted to said hair-planting framework are planted to said remaining two filament sections so as to extend thereabout.

13. The wig according to claim 12, wherein said two strands of hair planted to said remaining two filament sections are abutted against said one filament section and extend substantially perpendicularly to said hair-planting framework.

14. The wig according to claim 1, wherein said strands of hair planted to said hair-planting framework are either one of strands of natural hair, strands of synthetic hair and a mixture thereof.

15. The wig according to claim 1, including a plurality of strands of curly hair planted to said hair-planting framework by mixture with said strands of hair planted to said hair-planting framework, said strands of curly hair being shorter in length than said strands of hair planted to said hair-planting framework, thereby supporting said strands of hair outwardly.

16. The wig according to claim 15, wherein said strands of curly hair are planted to said hair-planting framework at locations adjacent said strands of hair planted to said hair-planting framework at predetermined intervals.

17. The wig according to claim 1, wherein said chain-like thread filaments include first elements extending longitudinally of said hair-planting framework and second elements extending latitudinally of said hair-planting framework to define said openings each of which is substantially rectangular in plan, said second elements extending perpendicularly to said strands of existing hair of the wearer and being abutted against a skin of the head of the wearer at locations in the vicinity of roots of the respective strands of existing hair.

18. The wig according to claim 1, wherein said hair-planting framework includes at least one second chain-like thread element extending between and being fastened to selected two of the first-mentioned chain-like thread elements, at least one of said strands of hair planted to said hair-planting framework being planted to said second chain-like thread element to partially increase said strands of hair planted to said hair-planting framework.

19. The wig according to claim 18, wherein the first-mentioned chain-like thread elements, said second chain-like thread element and the vicinity of roots of said strands of hair planted to said hair-planting framework are colored to their colors approximate to a color of a skin of the head of the wearer.

20. The wig according to claim 1, wherein one of each pair of chain-like thread elements intersected with each other is inserted through one of a plurality of links of the other chain-like thread element so that said other chain-like thread element is slidable along the length of said one chain-like thread element.

* * * * *